US009791813B2

(12) United States Patent
Fukuhata et al.

(10) Patent No.: US 9,791,813 B2
(45) Date of Patent: Oct. 17, 2017

(54) FIXING DEVICE AND IMAGE FORMING APPARATUS

(71) Applicants: Yoshihiro Fukuhata, Hyogo (JP); Yuusuke Furuichi, Kanagawa (JP); Tomohiko Fujii, Osaka (JP)

(72) Inventors: Yoshihiro Fukuhata, Hyogo (JP); Yuusuke Furuichi, Kanagawa (JP); Tomohiko Fujii, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/384,115

(22) Filed: Dec. 19, 2016

(65) Prior Publication Data

US 2017/0097599 A1 Apr. 6, 2017

Related U.S. Application Data

(62) Division of application No. 14/953,947, filed on Nov. 30, 2015, now Pat. No. 9,568,869.

(30) Foreign Application Priority Data

Dec. 25, 2014 (JP) ..... 2014-262025

(51) Int. Cl.
*G03G 15/20* (2006.01)

(52) U.S. Cl.
CPC ..... *G03G 15/2064* (2013.01)

(58) Field of Classification Search
CPC ..... G03G 15/2017; G03G 2215/2038; G03G 21/1685
USPC ..... 399/329
See application file for complete search history.

(56) References Cited

U.S. PATENT DOCUMENTS

| | | | |
|---|---|---|---|
| 3,435,500 | A * | 4/1969 | Aser et al. |
| 5,708,926 | A | 1/1998 | Sagara |
| 5,722,026 | A | 2/1998 | Goto |
| 5,960,243 | A | 9/1999 | Daigo |
| 9,342,014 | B2 | 5/2016 | Fukuhata et al. |
| 9,395,660 | B2 | 7/2016 | Fujii et al. |

(Continued)

FOREIGN PATENT DOCUMENTS

| | | | |
|---|---|---|---|
| JP | 09251252 | A * | 9/1997 |
| JP | 2004-286932 | | 10/2004 |

(Continued)

*Primary Examiner* — Benjamin Schmitt
*Assistant Examiner* — Milton Gonzalez
(74) *Attorney, Agent, or Firm* — Oblon, McClelland, Maier & Neustadt, L.L.P.

(57) ABSTRACT

A fixing device includes a fixing belt formed into a loop rotatable in a predetermined direction of rotation and a pressure roller disposed opposite the fixing belt. The pressure roller includes a shaft fixedly positioned and a deformable elastic layer. A fixing pad is disposed inside the loop formed by the fixing belt and separably pressed against the pressure roller via the fixing belt to form a fixing nip between the fixing belt and the pressure roller, through which a recording medium bearing a toner image is conveyed. A biasing member biases the fixing pad and the fixing belt against the pressure roller. A stopper restricts motion of the fixing pad biased by the biasing member. The stopper contacts the fixing pad while the recording medium bearing the toner image is conveyed through the fixing nip.

13 Claims, 4 Drawing Sheets

(56) References Cited

U.S. PATENT DOCUMENTS

| | | | |
|---|---|---|---|
| 2007/0223976 | A1 | 9/2007 | Yagi et al. |
| 2008/0013992 | A1 | 1/2008 | Fukuhata et al. |
| 2008/0013993 | A1 | 1/2008 | Obata et al. |
| 2008/0031664 | A1 | 2/2008 | Yagi et al. |
| 2008/0063442 | A1 | 3/2008 | Yagi et al. |
| 2008/0069611 | A1 | 3/2008 | Obata et al. |
| 2008/0304882 | A1 | 12/2008 | Shin |
| 2009/0075195 | A1 | 3/2009 | Shu |
| 2010/0178089 | A1 | 7/2010 | Fukuhata |
| 2010/0239297 | A1 | 9/2010 | Sakaya et al. |
| 2010/0260524 | A1 | 10/2010 | Hiraoka et al. |
| 2011/0052285 | A1 | 3/2011 | Fukuhata |
| 2011/0064490 | A1 | 3/2011 | Imada |
| 2011/0200373 | A1 | 8/2011 | Fujii et al. |
| 2011/0311283 | A1 | 12/2011 | Fukuhata |
| 2012/0002997 | A1 | 1/2012 | Hiraoka et al. |
| 2012/0020690 | A1 | 1/2012 | Yamamoto et al. |
| 2012/0177422 | A1 | 7/2012 | Nanno et al. |
| 2012/0275834 | A1 | 11/2012 | Naitoh et al. |
| 2013/0064586 | A1 | 3/2013 | Adachi et al. |
| 2014/0056625 | A1 | 2/2014 | Naitoh et al. |
| 2014/0072354 | A1 | 3/2014 | Toyoda et al. |
| 2014/0072357 | A1 | 3/2014 | Fukuhata et al. |
| 2014/0093288 | A1 | 4/2014 | Naitoh et al. |
| 2014/0099146 | A1 | 4/2014 | Fujii et al. |
| 2014/0112691 | A1 | 4/2014 | Nanno et al. |
| 2014/0153982 | A1 | 6/2014 | Adachi et al. |
| 2014/0153983 | A1 | 6/2014 | Fujii et al. |
| 2015/0139705 | A1 | 5/2015 | Furuichi et al. |
| 2015/0198920 | A1 | 7/2015 | Fukuhata et al. |
| 2015/0248091 | A1 | 9/2015 | Nanno et al. |
| 2016/0098000 | A1 | 4/2016 | Furuichi et al. |

FOREIGN PATENT DOCUMENTS

| | | |
|---|---|---|
| JP | 2004-286933 | 10/2004 |
| JP | 2004-294575 | 10/2004 |

* cited by examiner

FIXING DEVICE AND IMAGE FORMING APPARATUS

CROSS-REFERENCE TO RELATED APPLICATION

This patent application is a divisional application of U.S. application Ser. No. 14/953,947, filed Nov. 30, 2015, which is based on and claims priority pursuant to 35 U.S.C. §119 to Japanese Patent Application No. 2014-262025, filed on Dec. 25, 2014, in the Japanese Patent Office, the entire disclosures of each of the above which hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

For example, the fixing device may employ a free belt nip (FBN) system in which a fixing belt is not looped over a roller, a surface rapid fusing (SURF) system incorporating a heat resistant release layer, a pad fixing system that is advantageous in an AC-typical electricity consumption (TEC) value such as a quick start-up (QSU) system, or the like.

SUMMARY

This specification describes below an improved fixing device. In one exemplary embodiment, the fixing device includes a fixing belt formed into a loop rotatable in a predetermined direction of rotation and a pressure roller disposed opposite the fixing belt. The pressure roller includes a shaft fixedly positioned and a deformable elastic layer. A fixing pad is disposed inside the loop formed by the fixing belt and separably pressed against the pressure roller via the fixing belt to form a fixing nip between the fixing belt and the pressure roller, through which a recording medium bearing a toner image is conveyed. A biasing member biases the fixing pad and the fixing belt against the pressure roller. A stopper restricts motion of the fixing pad biased by the biasing member. The stopper contacts the fixing pad while the recording medium bearing the toner image is conveyed through the fixing nip.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing belt formed into a loop rotatable in a predetermined direction of rotation and a pressure roller disposed opposite the fixing belt. The pressure roller includes a shaft fixedly positioned and a deformable elastic layer. A fixing pad is disposed inside the loop formed by the fixing belt and separably pressed against the pressure roller via the fixing belt to form a fixing nip between the fixing belt and the pressure roller, through which the recording medium bearing the toner image is conveyed. A biasing member biases the fixing pad and the fixing belt against the pressure roller. A stopper restricts motion of the fixing pad biased by the biasing member. The stopper contacts the fixing pad while the recording medium bearing the toner image is conveyed through the fixing nip.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
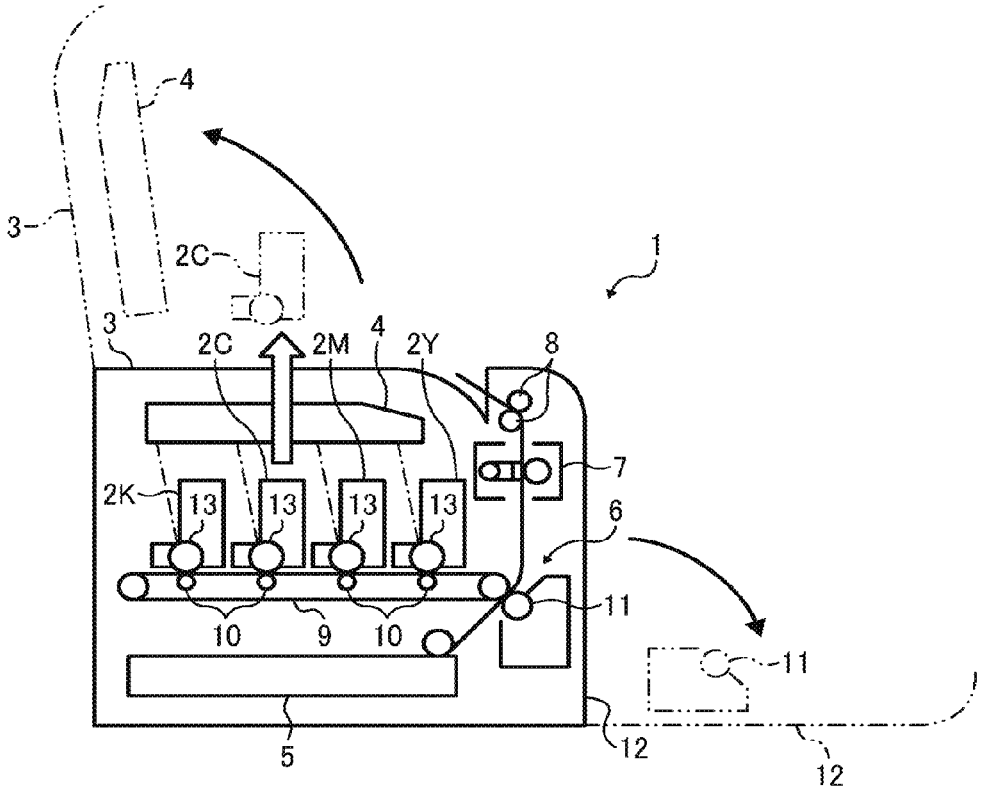
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on a recording medium by electrophotography. Alternatively, the image forming apparatus 1 may be a monochrome printer that forms a monochrome toner image on a recording medium.

With reference to FIG. 1, a description is provided of a construction of the image forming apparatus 1.

It is to be noted that, in the drawings for explaining exemplary embodiments of this disclosure, identical reference numerals are assigned as long as discrimination is possible to components such as members and component parts having an identical function or shape, thus omitting description thereof once it is provided.

The image forming apparatus 1 is a color printer that forms color and monochrome toner images on recording media by electrophotography. Four process units 2Y, 2M, 2C, and 2K serving as an image forming device are located in a center portion of the image forming apparatus 1. Although the process units 2Y, 2M, 2C, and 2K contain developers (e.g., yellow, magenta, cyan, and black toners) in different colors, that is, yellow, magenta, cyan, and black corresponding to color separation components of a color image, respectively, they have an identical structure.

For example, each of the process units 2Y, 2M, 2C, and 2K includes a photoconductor 13 serving as an image bearer or a latent image bearer that bears an electrostatic latent image and a resultant toner image; a charging device serving as a charger that charges an outer circumferential surface of the photoconductor 13; a developing device that supplies the developer (e.g., toner) to the electrostatic latent image formed on the outer circumferential surface of the photoconductor 13, thus visualizing the electrostatic latent image as a toner image; and a cleaning device serving as a cleaner that cleans the outer circumferential surface of the photoconductor 13.

For example, the developer includes toner containing oily silica, that is, silica containing oil, as an additive. The toner may be pulverized toner or polymerization toner. According to this exemplary embodiment, hydrophobic silica (product name RY50 available from AEROSIL®) in an amount of 2 parts by weight is added to toner in an amount of 100 parts by weight and mixed for 5 minutes with a 20 L Henschel mixer at a circumferential velocity of 40 m/sec. Thereafter, the mixture is screened through a sieve with an aperture of 75 microns to obtain toner.

Each of the four process units 2Y, 2M, 2C, and 2K is removably installed in the image forming apparatus 1. As a user lifts and pivots an upper cover 3 disposed atop the image forming apparatus 1 as illustrated in a long and short dashed line in FIG. 1, the user lifts and removes each of the process units 2Y, 2M, 2C, and 2K from the image forming apparatus 1 and lowers and installs each of the process units 2Y, 2M, 2C, and 2K into the image forming apparatus 1.

Above the process units 2Y, 2M, 2C, and 2K is an exposure device 4 that exposes the outer circumferential surface of the respective photoconductors 13 with laser beams. The exposure device 4 is attached to the upper cover 3. Hence, as the user lifts the upper cover 3, the exposure device 4 is retracted from a space above the process units 2Y, 2M, 2C, and 2K together with the upper cover 3. Thus, the exposure device 4 facilitates removal and installation of the process units 2Y, 2M, 2C, and 2K.

The image forming apparatus 1 further includes a sheet feeder 5 serving as a recording medium supply that supplies a sheet serving as a recording medium; a transfer device 6 serving as a transferor that transfers a toner image formed by the process units 2Y, 2M, 2C, and 2K onto the sheet; a fixing device 7 that fixes the toner image on the sheet; and an output roller pair 8 serving as a recording medium ejector that ejects the sheet bearing the fixed toner image onto an outside of the image forming apparatus 1.

For example, the transfer device 6 includes an endless intermediate transfer belt 9, four primary transfer rollers 10 serving as primary transferors, and a secondary transfer roller 11 serving as a secondary transferor. The four primary transfer rollers 10 are pressed against the four photoconductors 13 of the four process units 2Y, 2M, 2C, and 2K, respectively, via the intermediate transfer belt 9, forming four primary transfer nips between the intermediate transfer belt 9 and the photoconductors 13. The secondary transfer roller 11 is pressed against one of a plurality of rollers across which the intermediate transfer belt 9 is stretched taut via the intermediate transfer belt 9, forming a secondary transfer nip between the secondary transfer roller 11 and the intermediate transfer belt 9.

The secondary transfer roller 11 is attached to a front cover 12 that is opened and closed by the user. As the user pivots and opens the front cover 12 toward the user, the secondary transfer roller 11 separates from the intermediate transfer belt 9 as illustrated in a long and short dashed line in FIG. 1. Thus, the secondary transfer roller 11 facilitates removal of the sheet jammed at the secondary transfer nip.

With reference to FIG. 1, a description is provided of an image forming operation performed by the image forming apparatus 1 having the construction described above to form a full color toner image on a sheet.

As the image forming apparatus 1 receives a print job, the process units 2Y, 2M, 2C, and 2K form yellow, magenta, cyan, and black toner images, respectively. For example, in each of the process units 2Y, 2M, 2C, and 2K, the photoconductor 13 is driven and rotated and the charging device uniformly charges the outer circumferential surface of the photoconductor 13 at a predetermined polarity.

The exposure device 4 exposes the outer circumferential surface of the photoconductor 13 with a laser beam, forming an electrostatic latent image on the photoconductor 13 according to monochrome image data, that is, yellow, magenta, cyan, and black image data created by decomposing desired full color image data. The developing device supplies toner to the electrostatic latent image formed on the photoconductor 13, developing or visualizing the electrostatic latent image into a toner image, that is, yellow, magenta, cyan, and black toner images.

The yellow, magenta, cyan, and black toner images are primarily transferred from the photoconductors 13 onto the intermediate transfer belt 9 successively at the primary transfer nips such that the yellow, magenta, cyan, and black toner images are superimposed on a same position on the intermediate transfer belt 9. The cleaning device removes residual toner failed to be transferred onto the intermediate transfer belt 9 and therefore remaining on the photoconductor 13 therefrom. The yellow, magenta, cyan, and black toner images superimposed on the intermediate transfer belt 9 are secondarily transferred onto the sheet conveyed from the sheet feeder 5 at the secondary transfer nip collectively. Thus, a full color toner image is formed on the sheet. The sheet bearing the full color toner image, after passing through the secondary transfer nip, is conveyed to the fixing device 7 that fixes the full color toner image on the sheet. Thereafter, the sheet bearing the fixed full color toner image is ejected by the output roller pair 8 onto the outside of the image forming apparatus 1.

The above describes the image forming operation of the image forming apparatus 1 to form the full color toner image on the sheet. Alternatively, the image forming apparatus 1 may form toner images other than the full color toner image. For example, the image forming apparatus 1 may form a monochrome toner image by using any one of the four process units 2Y, 2M, 2C, and 2K or may form a bicolor or tricolor toner image by using two or three of the process units 2Y, 2M, 2C, and 2K.

A description is provided of a construction of a comparative fixing device employing a pad fixing system.

The comparative fixing device includes a pressure roller driven and rotated by a motor; a heating roller inside which a heater is disposed; a nip formation pad disposed opposite the pressure roller; and a fixing belt rotatably looped over the heating roller and the nip formation pad.

While the pressure roller is pressed against the fixing belt supported by the nip formation pad, the pressure roller is rotated to drive and rotate the fixing belt. As a sheet bearing a toner image is conveyed through a fixing nip formed between the fixing belt and the pressure roller, the fixing belt and the pressure roller melt and fix the toner image on the sheet.

As an elastic layer constituting an outer circumferential surface of the pressure roller thermally expands, pressure exerted at the fixing nip may change partially, rendering it difficult to maintain a constant pressure distribution at the fixing nip in an axial direction of the pressure roller. Accordingly, the fixing belt may skew in an axial direction thereof. Consequently, a lateral end of the fixing belt in the axial direction thereof may be damaged or the sheet may be jammed between the fixing belt and the pressure roller.

A description is provided of a construction of the fixing device 7 incorporated in the image forming apparatus 1 having the construction described above.

Figure 2:
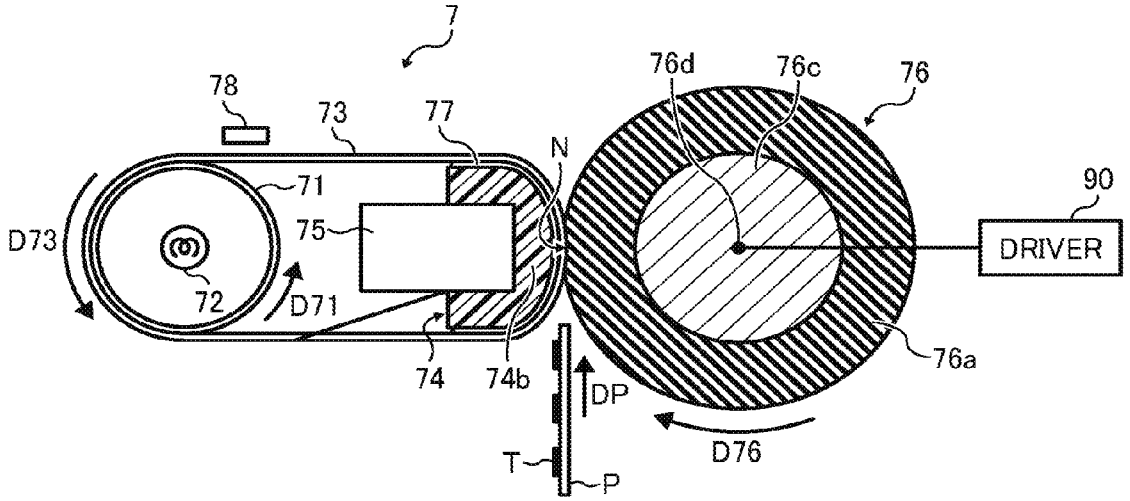
FIG. 2 is a schematic vertical sectional view of a fixing device installed in the image forming apparatus shown in FIG. 1.
Figure 3:
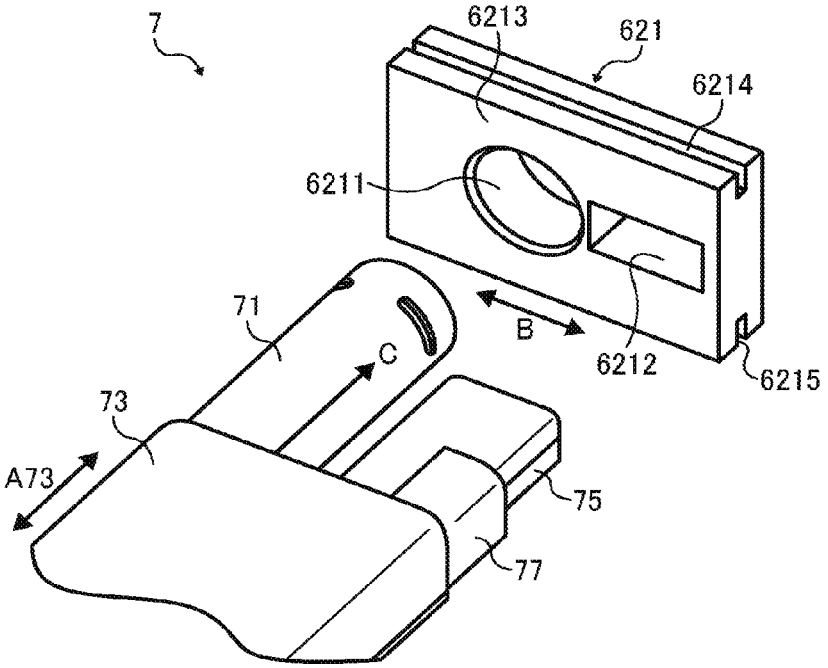
FIG. 3 is a partial perspective view of the fixing device shown in FIG. 2.

FIG. 2 is a schematic vertical sectional view of the fixing device 7. FIG. 3 is a partial perspective view of the fixing device 7.

As shown in FIG. 2, the fixing device 7 (e.g., a fuser or a fusing unit) includes a heating roller 71 inside which a heater 72 (e.g., a halogen heater) is disposed; a fixing pad 74; a stay 75 mounting and supporting the fixing pad 74; and a fixing belt 73 looped over the heating roller 71 and the fixing pad 74 and rotatable in a rotation direction D73. The fixing device 7 further includes a pressure roller 76 disposed opposite the fixing pad 74 via the fixing belt 73; and a temperature sensor 78 disposed opposite the fixing belt 73 to detect the temperature of the fixing belt 73. As shown in FIG. 3, the fixing device 7 further includes a lateral end support plate 621 that supports the heating roller 71 and the stay 75. When the temperature of the fixing belt 73 depicted in FIG. 2 increases excessively, the temperature sensor 78 detects the increased temperature of the fixing belt 73 and power supply to the heater 72 is interrupted.

The fixing pad 74 is pressed against the pressure roller 76 via the fixing belt 73 to form a fixing nip N between the fixing belt 73 and the pressure roller 76. The heater 72 heats the heating roller 71 which in turn heats the fixing belt 73. As a sheet P bearing a toner image T is conveyed through the fixing nip N upward in FIG. 2 in a sheet conveyance direction DP, the fixing belt 73 and pressure roller 76 melt and fix the toner image T on the sheet P under heat and pressure. A conveyance guide is disposed upstream from the fixing nip N in the sheet conveyance direction DP to guide the sheet P to the fixing nip N. A separator and a conveyance guide are disposed downstream from the fixing nip N in the sheet conveyance direction DP. The separator separates the sheet P from the fixing belt 73. The conveyance guide guides the sheet P to an outside of the fixing device 7.

Figure 4:
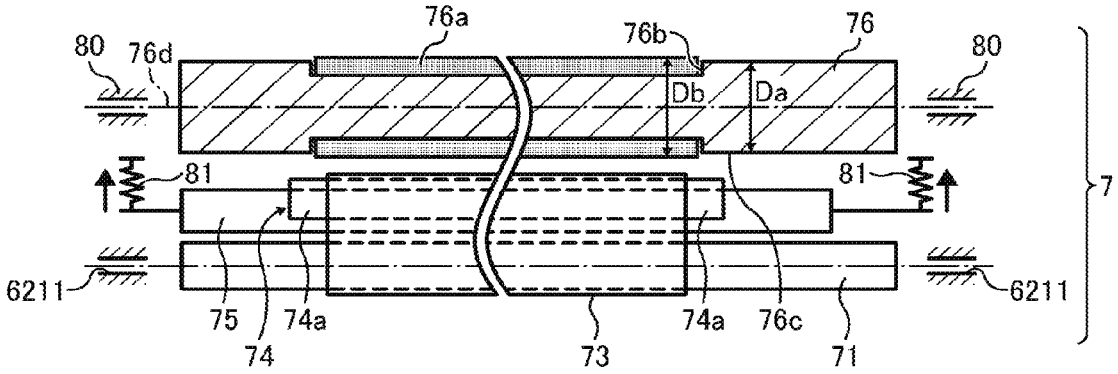
FIG. 4 is a plan view of the fixing device shown in FIG. 2 illustrating a fixing belt isolated from a pressure roller.
Figure 5:
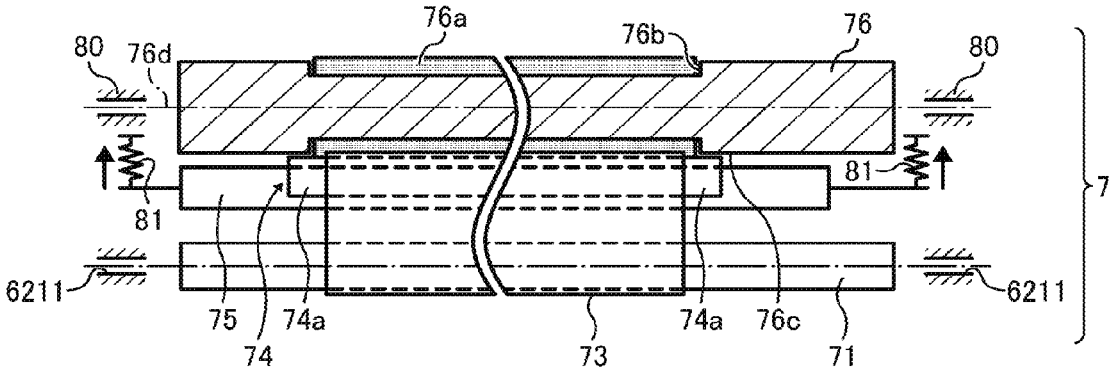
FIG. 5 is a plan view of the fixing device shown in FIG. 2 illustrating the fixing belt contacting the pressure roller.
Figure 6:
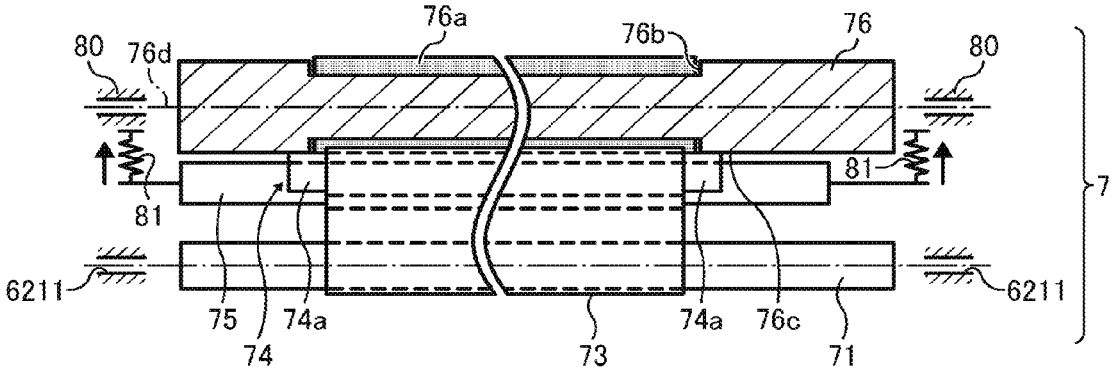
FIG. 6 is a plan view of the fixing device shown in FIG. 2 illustrating the fixing belt and a fixing pad that contact the pressure roller.

FIG. 4 is a plan view of the fixing device 7 illustrating the fixing belt 73 isolated from the pressure roller 76. FIG. 5 is a plan view of the fixing device 7 illustrating the fixing belt 73 contacting the pressure roller 76. FIG. 6 is a plan view of the fixing device 7 illustrating the fixing belt 73 and the fixing pad 74 that contact the pressure roller 76. The fixing device 7 employs a pad fixing system to fix a toner image T on a sheet P with a construction incorporating a pad (e.g., the fixing pad 74). The fixing device 7 is removably installed in the image forming apparatus 1 shown in FIG. 1.

As shown in FIG. 2, in order to even a width of the fixing nip N in an axial direction of the pressure roller 76, a shaft 76*d* of the pressure roller 76 that is connected to a driver 90 (e.g., a motor) is fixedly positioned inside the fixing device 7. Conversely, the fixing pad 74 is separably pressed against the pressure roller 76 such that the fixing pad 74 moves closer to and away from the pressure roller 76. A biasing member 81 shown in FIGS. 4 to 6 biases or presses the fixing pad 74 against the pressure roller 76 via the fixing belt 73 to form the fixing nip N having a predetermined length in the sheet conveyance direction DP.

If the fixing pad 74 is configured to merely press against the pressure roller 76, as an elastic layer 76*a* depicted in FIG. 2 of the pressure roller 76 expands thermally, the thermally expanded elastic layer 76*a* presses back against the fixing pad 74, changing a pressing amount of the fixing pad 74 pressing against the pressure roller 76. Accordingly, tension exerted to the fixing belt 73 changes and therefore moves or skews the fixing belt 73 in an axial direction thereof, damaging a lateral end of the fixing belt 73 in the axial direction thereof. Additionally, change in tension exerted to the fixing belt 73 changes a direction of a conveyance path of the sheet P, that is, the sheet conveyance direction DP, and therefore the sheet P is jammed between the fixing belt 73 and the pressure roller 76.

To address this circumstance, a configuration to maintain the pressing amount of the fixing pad 74 regardless of thermal expansion of the elastic layer 76*a* of the pressure roller 76 is requested. According to this exemplary embodiment, the fixing device 7 has the configuration to maintain the pressing amount of the fixing pad 74 pressing against the elastic layer 76*a* of the pressure roller 76 regardless of thermal expansion of the elastic layer 76*a*.

As described above, the fixing pad 74 is pressed against the elastic layer 76*a* of the pressure roller 76 via the fixing belt 73 to form the fixing nip N between the fixing belt 73 and the pressure roller 76. As the fixing pad 74 is pressed against the pressure roller 76, the fixing pad 74 is pressed first against an axial span of the pressure roller 76 where the elastic layer 76*a* spans in the axial direction of the pressure roller 76.

As shown in FIG. 4, a width of the fixing pad 74 is greater than a width of the fixing belt 73 in the axial direction thereof. For example, each lateral end portion 74*a* of the fixing pad 74 projects from or is disposed outboard from each lateral edge of the fixing belt 73 for a predetermined length in the axial direction of the fixing belt 73. After the fixing pad 74 is pressed against the axial span of the elastic layer 76*a* first as described above, each lateral end portion 74*a* of the fixing pad 74 comes into contact with a cored bar land 76*c* serving as a cored bar of the pressure roller 76. The cored bar land 76*c* is disposed outboard from the elastic layer 76*a* in the axial direction of the pressure roller 76 and disposed at each lateral end of the pressure roller 76 in the axial direction thereof. As the lateral end portion 74*a* of the fixing pad 74 contacts the cored bar land 76*c* of the pressure roller 76 as shown in FIG. 6, the cored bar land 76*c* prohibits the fixing pad 74 from pressing against the pressure roller 76 further. Thus, the cored bar land 76*c* serves as a stopper that restricts motion of the fixing pad 74 biased by the biasing member 81 and defines a closest position or a closest approach of the fixing pad 74 relative to the pressure roller 76.

The lateral end portion 74*a* of the fixing pad 74 contacting the cored bar land 76*c* of the pressure roller 76 retains a constant, relative distance between the fixing pad 74 and an axis of the pressure roller 76 in a direction perpendicular to the axial direction of the pressure roller 76. Even if the elastic layer 76*a* of the pressure roller 76 expands thermally, the biasing member 81 presses the fixing pad 74 against the pressure roller 76 with an increased force great enough to offset thermal expansion of the elastic layer 76*a*, retaining the pressing amount of the fixing pad 74 pressing against the elastic layer 76*a* of the pressure roller 76 constantly.

A shaft of the heating roller 71 and the shaft 76*d* of the pressure roller 76 are mounted on and supported by a support located in the fixing device 7. As shown in FIG. 3, the shaft of the heating roller 71 is inserted into and supported by a circular heating roller supporting through-hole 6211 penetrating through the lateral end support plate 621 serving as the support. As shown in FIG. 4, the shaft 76*d* of the pressure roller 76 is supported by a bearing 80 of another support plate serving as the support. The heating roller 71 and the pressure roller 76 are connected to separate motors serving as drivers located inside the image forming apparatus 1 through gear trains and the like, respectively.

As shown in FIG. 2, as the driver 90 drives and rotates the pressure roller 76 in a rotation direction D76, the pressure roller 76 frictionally rotates the fixing belt 73 in the rotation direction D73. The heating roller 71 rotating in a rotation direction D71 also frictionally rotates the fixing belt 73 in the rotation direction D73. For example, as a driving force is transmitted from the pressure roller 76 to the fixing belt 73 at the fixing nip N, the fixing belt 73 rotates in accordance with rotation of the pressure roller 76. The fixing belt 73 is also driven and rotated supplementally by the heating roller 71 disposed opposite the pressure roller 76 via the fixing nip N.

The heating roller 71 is driven and rotated in the rotation direction D71 identical to the rotation direction D73 of the fixing belt 73 at a circumferential velocity higher than that of the pressure roller 76 by a range of from 1 percent to 10 percent. A lower limit of 1 percent defines increase in the circumferential velocity by 1 percent or more even if an error is considered. The circumferential velocity of the heating roller 71 is increased due to a reason described below. The fixing belt 73 is driven typically by a driving force of the pressure roller 76 connected to the motor of the driver 90 and rotated in accordance with rotation of the pressure roller 76. In this case, the heating roller 71 is driven and rotated by the fixing belt 73.

However, conveyance of the sheet P by the fixing belt 73 is destabilized during printing, that is, while the sheet P is conveyed through the fixing nip N. If the fixing belt 73 is driven solely by the driving force of the pressure roller 76 and rotated in accordance with rotation of the pressure roller 76, it may be difficult to stabilize conveyance of the sheet P by the fixing belt 73. To address this circumstance, the circumferential velocity of the heating roller 71 is slightly increased relative to the circumferential velocity of the pressure roller 76, thus stabilizing conveyance of the sheet P by the fixing belt 73.

A description is provided of the position of the shaft 76*d* of the pressure roller 76.

As described above with reference to FIG. 4, the shaft 76*d* of the pressure roller 76 is mounted on and supported by the bearing 80 of the support located in the fixing device 7. Typically, the fixing pad 74 is mounted on the support and the shaft 76*d* of the pressure roller 76 is supported by the support such that the pressure roller 76 is separably pressed against the fixing pad 74 via the fixing belt 73. To address a circumstance described below, according to this exemplary embodiment, the shaft 76*d* of the pressure roller 76 is mounted on and supported by the bearing 80 of the support located in the fixing device 7.

If the pressure roller 76 is movable relative to the fixing pad 74, as the pressure roller 76 is rotated by a driving force transmitted through a gear disposed at one lateral end, that is, a driven end of the pressure roller 76 in the axial direction thereof, a tangential force of the gear is also transmitted to the pressure roller 76 with a rotational torque. Accordingly, the tangential force increases and decreases pressure exerted from the pressure roller 76 to the fixing pad 74. The tangential force is exerted to the driven end of the pressure roller 76 that meshes with the gear. Consequently, the length of the fixing nip N in the sheet conveyance direction DP may vary in the axial direction of the pressure roller 76. For example, if pressure exerted from the pressure roller 76 to the fixing pad 74 increases gradually toward the driven end of the pressure roller 76, the length of the fixing nip N in the sheet conveyance direction DP may increase toward the driven end of the pressure roller 76.

If the length of the fixing nip N in the sheet conveyance direction DP varies between one lateral end and another lateral end of the pressure roller 76 in the axial direction thereof, the fixing belt 73 may skew toward one lateral end in the axial direction thereof.

Accordingly, one lateral end of the fixing belt 73 in the axial direction thereof may run on a belt stopper disposed at one lateral end of the fixing pad 74 in the axial direction of the fixing belt 73 or may suffer from breakage by frictional contact with the belt stopper. An experiment with a default length of the fixing nip N in the sheet conveyance direction DP of 5.0 mm showed an increased length of the fixing nip N of 5.3 mm produced at the driven end of the pressure roller 76 and an unchanged length of the fixing nip N of 5.0 mm at a center and another lateral end of the pressure roller 76 that was not connected to the motor. After the fixing belt 73 continued rotating under the varied length of the fixing nip N for about an hour, the lateral end of the fixing belt 73 in the axial direction thereof was broken.

To address this circumstance, it is requested to fixedly position the shaft 76*d* of the pressure roller 76 and thereby even the length of the fixing nip N in the sheet conveyance direction DP between one lateral end and another lateral end of the pressure roller 76 in the axial direction thereof. According to this exemplary embodiment, the shaft 76*d* of the pressure roller 76 is fixedly positioned. Contrarily, the fixing pad 74 is movable relative to the pressure roller 76. That is, the fixing pad 74 is separably pressed against the pressure roller 76.

A description is provided of a mechanism that moves the fixing pad 74 with reference to the lateral end support plate 621 shown in FIG. 3.

First, a detailed description is provided of a construction of the lateral end support plate 621. FIG. 3 is a diagram showing the construction of the lateral end support plate 621 serving as a support that supports each lateral end of the heating roller 71 and the stay 75 in the axial direction of the fixing belt 73. The lateral end support plate 621 is a rectangular plate made of heat resistant resin or the like that facilitates sliding of the fixing belt 73 over the lateral end support plate 621.

According to this exemplary embodiment, the lateral end support plate 621 is made of polytetrafluoroethylene (PTFE) that barely damages the fixing belt 73. Alternatively, the lateral end support plate 621 may be made of heat resistant resin that facilitates sliding of the fixing belt 73 over the lateral end support plate 621 such as liquid crystal polymer, polyphenylene sulfide (PPS), and polyamide imide (PAI). Yet alternatively, the lateral end support plate 621 may be made of heat resistant fluoroplastic. Thus, the lateral end support plate 621 achieves heat resistance and slide property of facilitating sliding of the fixing belt 73 over the lateral end support plate 621, extending a life of the fixing belt 73.

The lateral end support plate 621 includes the circular heating roller supporting through-hole 6211 and a rectangular stay supporting through-hole 6212 arranged in a direction B perpendicular to an axial direction A73 of the fixing belt 73. The circular heating roller supporting through-hole 6211 serves as a shaft through-hole that rotatably supports an end of the shaft of the heating roller 71 in an axial direction thereof. The rectangular stay supporting through-hole 6212 serves as a stay through-hole that supports an end of the stay 75 in a longitudinal direction thereof parallel to the axial direction A73 of the fixing belt 73.

Grooves 6214 and 6215 (e.g., recesses) are disposed on downstream and upstream edges, that is, upper and lower edges in FIG. 3, of the lateral end support plate 621 in the sheet conveyance direction DP, respectively. The grooves 6214 and 6215 engage a platy frame of the fixing device 7 to attach the lateral end support plate 621 to the platy frame. For example, each of the grooves 6214 and 6215 mounted on the lateral end support plate 621 engages each of upper and lower edges of a lateral slit of the platy frame horizontally in FIG. 3.

A pair of lateral end support plates 621 having an identical shape is disposed parallel to each other. Accordingly, the circular heating roller supporting through-hole 6211 and the rectangular stay supporting through-hole 6212 of one of the pair of lateral end support plates 621 are symmetrical to the circular heating roller supporting through-hole 6211 and the rectangular stay supporting through-hole 6212 of another one of the pair of lateral end support plates 621. Consequently, the heating roller 71 is parallel to the fixing pad 74 precisely. Precise parallelism between the heating roller 71 and the fixing pad 74 prevents variation in tension of the fixing belt 73 in the axial direction thereof that may cause skew of the fixing belt 73. Accordingly, the fixing belt 73 barely skews in the axial direction thereof, extending the life thereof.

The stay supporting through-hole 6212 supports the stay 75 such that the stay 75 is slidable rightward and leftward in FIG. 3 in the direction B perpendicular to the axial direction A73 of the fixing belt 73, thus exerting a predetermined tension to the fixing belt 73. A length of the stay supporting through-hole 6212 in the direction B is slightly greater than a length of the stay 75 in the direction B. As shown in FIG. 6, the biasing member 81 (e.g., a spring) biases the stay 75 upward, that is, rightward in FIG. 3, toward the pressure roller 76.

As shown in FIG. 3, the lateral end support plate 621 includes a planar skew restraint face 6213 serving as a skew restraint. The skew restraint face 6213 of one of the pair of lateral end support plates 621 is disposed opposite the skew restraint face 6213 of another one of the pair of lateral end support plates 621. The skew restraint face 6213 defines an entire interior face of the lateral end support plate 621. The circular lateral edge of the fixing belt 73 defining a circumferential direction thereof separably comes into contact with the skew restraint face 6213.

The lateral end support plate 621 serving as a support that supports the heating roller 71 and the stay 75 mounts the skew restraint face 6213, downsizing the fixing device 7 and reducing manufacturing costs. Alternatively, the skew restraint face 6213 may not define the entire interior face of the lateral end support plate 621. For example, the skew restraint face 6213 may be mounted on at least a restricted region around the circular heating roller supporting through-hole 6211 that is disposed opposite the fixing pad 74 via the stay 75. Thus, the skew restraint face 6213 reduces friction between the fixing belt 73 and the skew restraint face 6213.

The lateral end support plate 621 is disposed opposite each lateral edge of the fixing belt 73 entirely in the circumferential direction thereof to restrict motion of the fixing belt 73 at each lateral edge in the axial direction entirely in the circumferential direction of the fixing belt 73. For example, as the fixing belt 73 skews for an increased distance in a direction C, at most, the entire lateral edge of the fixing belt 73 in the circumferential direction thereof comes into contact with the skew restraint face 6213 of the lateral end support plate 621. Thus, the skew restraint face 6213 restricts motion of the fixing belt 73.

A description is provided of a configuration of the heating roller 71.

As shown in FIG. 2, the heating roller 71 is a hollow tube. The heating roller 71 is produced by processing a metal pipe made of aluminum, iron, stainless steel, or the like. According to this exemplary embodiment, an iron pipe having a predetermined diameter is cut into the heating roller 71 having a predetermined width in the axial direction thereof.

Alternatively, instead of the halogen heater, a resistive heat generator, a carbon heater, or the like may be employed as the heater 72 disposed inside the heating roller 71, if a decreased interval is provided between the heating roller 71 and the heater 72 and a space is barely spared at a lateral end of the heating roller 71 in the axial direction thereof. Yet alternatively, an electromagnetic induction heater (IH) or the like may be employed as the heater 72. According to this exemplary embodiment, the halogen heater of 550 W is used as the heater 72.

The heating roller 71 is circular in cross-section and has an inner diameter greater than an apparent diameter of the heater 72 by 1 mm. An inner circumferential surface of the heating roller 71 is treated with black coating to facilitate absorption of heat radiated from the heater 72 and the like.

An inner circumferential surface of the fixing belt 73 is applied with a lubricant such as silicone oil and fluorine grease to reduce friction between the fixing pad 74 and a slide sheet 77 that covers the fixing pad 74 to reduce friction between the slide sheet 77 and the fixing belt 73. Accordingly, the lubricant may be interposed between the heating roller 71 and the fixing belt 73.

Since the heating roller 71 drives and rotates the fixing belt 73 to aid conveyance of the sheet P by the fixing belt 73, in order to transmit a driving force from the heating roller 71 to the fixing belt 73 effectively, the inner circumferential surface of the heating roller 71 may be roughened slightly to retain the lubricant readily. For example, the heating roller 71 has a surface roughness of Ra 10 or smaller. Various methods for increasing the surface roughness of the heating roller 71 are available: a method for increasing the surface roughness physically by sandblasting; a method for increasing the surface roughness chemically by etching; and a method for increasing the surface roughness by applying a coating mixed with small-diameter beads. Any one of those methods may be employed.

A description is provided of a configuration of the fixing pad 74.

The fixing pad 74, made of an elastic body such as silicone rubber and fluoro rubber, heat resistant resin, or metal. The fixing pad 74 is mounted on and supported by the stay 75 that is rectangular in cross-section and formed in a rod. As shown in FIG. 6, as the biasing member 81 such as a spring biases the stay 75 toward the pressure roller 76, the stay 75 presses the fixing pad 74 against the pressure roller 76.

Figure 7:
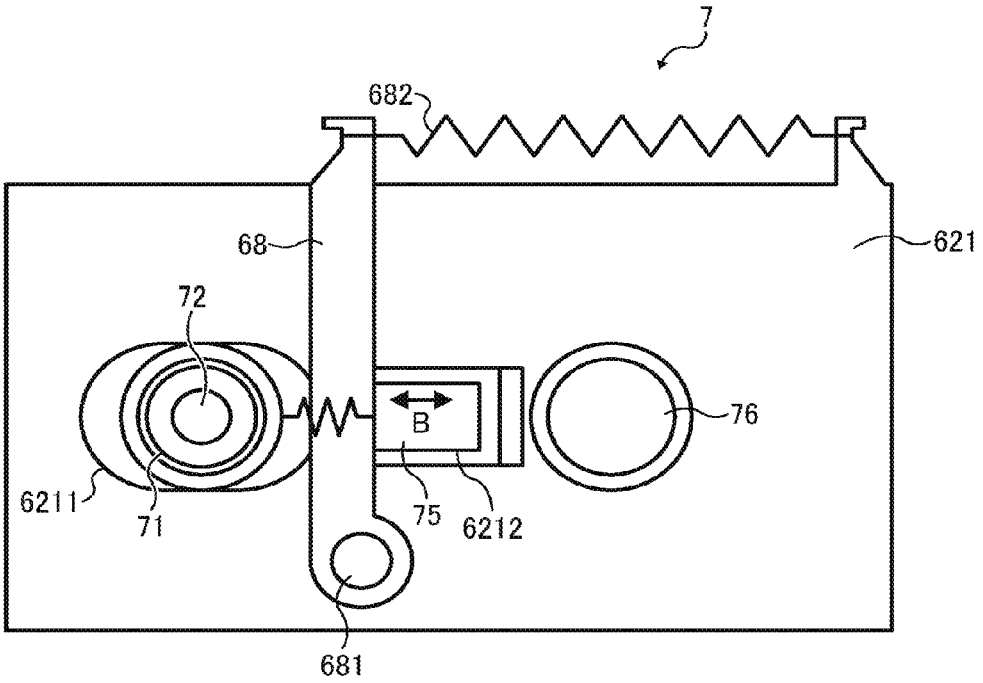
FIG. 7 is a vertical sectional view of the fixing device shown in FIG. 2 illustrating a lever incorporated therein.

A handle such as a lever is coupled to each lateral end of the stay 75 in the longitudinal direction thereof as shown in FIG. 7. FIG. 7 is a vertical sectional view of the fixing device 7 illustrating a lever 68 that moves the stay 75. The lever 68 is pivotable about a shaft 681 mounted on the lateral end support plate 621. A pressure spring 682 anchored to the lever 68 and the lateral end support plate 621 causes the lever 68 to press the stay 75 against the fixing pad 74.

The user uses the lever 68 to move the stay 75 in the direction B depicted in FIGS. 3 and 7. As the stay 75 moves in the direction B, the stay 75 switches pressurization of the fixing pad 74. For example, the stay 75 presses the fixing pad 74 against the pressure roller 76 and releases pressure exerted from the fixing pad 74 to the pressure roller 76. Thus, the lever 68 serves as a bias releaser that releases a bias exerted to the fixing pad 74 from the biasing member 81 depicted in FIGS. 4 to 6. The stay 75 releases pressure exerted from the fixing pad 74 to the pressure roller 76 at least when the user removes the sheet P jammed between the fixing belt 73 and the pressure roller 76. Accordingly, when the sheet P is jammed at the fixing nip N formed between the fixing belt 73 and the pressure roller 76, the user removes the sheet P from the fixing nip N readily.

As shown in FIG. 2 illustrating a cross-section of the fixing pad 74, the fixing pad 74 includes an arcuate bulge 74*b* that projects toward the pressure roller 76. A height of the bulge 74*b* defines a bulge amount of the bulge 74*b* projecting toward the pressure roller 76. A center portion of the bulge 74*b* in a longitudinal direction of the fixing pad 74 parallel to the axial direction of the fixing belt 73 has an increased height that is increased gradually from each lateral end of the bulge 74*b* in the longitudinal direction of the fixing pad 74 by about 0.5 mm. The center portion of the bulge 74*b* in the longitudinal direction of the fixing pad 74 projects most toward the pressure roller 76.

The fixing pad 74 and the stay 75 supporting the fixing pad 74 are bent most at a center portion in the longitudinal direction thereof by a reaction force exerted from the pressure roller 76. To address this circumstance, the center portion of the bulge 74*b* of the fixing pad 74 has the increased height, thus preventing insufficient pressure exerted at the fixing nip N. In view of a load imposed to the fixing pad 74 from the stay 75, a configuration of the stay 75, and a size of the sheet P (e.g., an A3 size and an A4 size), the greatest height of the bulge 74*b* is about 0.5 mm.

As another method to prevent variation in the axial direction of the fixing belt 73 in the length of the fixing nip N in the sheet conveyance direction DP, the distance between the fixing pad 74 and the axis of the pressure roller 76 may be fixed in the direction perpendicular to the axial direction of the pressure roller 76. In this case, the constant distance between the fixing pad 74 and the axis of the pressure roller 76 is retained even when the sheet P is conveyed through the fixing nip N. Accordingly, when a thick sheet P having a relatively greater thickness is conveyed through the fixing nip N, a driving torque needed to rotate the pressure roller 76 and the heating roller 71 may increase sharply.

Accordingly, the pressure roller 76 and the heating roller 71 may suffer from shortage of the driving torque, although the shortage varies depending on the motor. Consequently, the pressure roller 76 and the heating roller 71 may stop or rotate slowly. Stoppage and rotation at a decreased velocity of the pressure roller 76 or the heating roller 71 may fatally degrade the toner image T formed on the sheet P. Hence, it is impossible to employ the method to fix the distance between the fixing pad 74 and the axis of the pressure roller 76 in the direction perpendicular to the axial direction of the pressure roller 76.

As shown in FIG. 2, a pressure roller side portion or a right portion of the fixing pad 74, that is, the bulge 74*b*, is pressed against the inner circumferential surface of the fixing belt 73 via the slide sheet 77. Heat resistant grease serving as a lubricant is applied between the fixing belt 73 and the slide sheet 77 as needed to stabilize rotation of the fixing belt 73. The pressure roller side portion of the fixing pad 74, that is, the bulge 74*b*, may be pressed against the inner circumferential surface of the fixing belt 73 directly, not via the slide sheet 77. In this case, the pressure roller side portion of the fixing pad 74 is coated with a slide layer that facilitates sliding of the fixing belt 73 over the fixing pad 74 as needed.

Thus, the fixing pad 74 is pressed against the inner circumferential surface of the fixing belt 73 via the slide sheet 77 or the slide layer in direct contact with inner circumferential surface of the fixing belt 73. According to this exemplary embodiment, the fixing pad 74 made of resin is pressed against the inner circumferential surface of the fixing belt 73 via the slide sheet 77. A lubricant such as grease and silicone oil is interposed between the inner circumferential surface of the fixing belt 73 and the slide sheet 77 to facilitate sliding of the fixing belt 73 over the slide sheet 77.

As the fixing pad 74 receives a load from the pressure roller 76 through the fixing belt 73 and the slide sheet 77, the fixing pad 74 forms the fixing nip N together with the pressure roller 76. As a sheet P bearing a toner image T is conveyed through the fixing nip N, the fixing belt 73 and the pressure roller 76 apply heat and pressure to the sheet P at the fixing nip N, thus melting and fixing the toner image T on the sheet P.

A description is provided of a configuration of the fixing belt 73.

The fixing belt 73 includes a base layer made of resin such as polyimide, polyamide, and fluoroplastic. According to this exemplary embodiment, the base layer of the fixing belt 73 is made of polyimide. The fixing belt 73 is an endless belt or film. The fixing belt 73 further includes a release layer constituting a surface layer and made of resin such as tetrafluoroethylene-perfluoroalkylvinylether copolymer (PFA) and PTFE to facilitate separation of toner of the toner image T on the sheet P from the fixing belt 73, thus preventing toner of the toner image T from adhering to the fixing belt 73. The base layer of the fixing belt 73, made of polyimide and constituting the inner circumferential surface of the fixing belt 73 that contacts the heating roller 71, has a surface roughness not greater than Ra 5. The inner circumferential surface of the fixing belt 73 is applied with silicone oil or grease.

An elastic layer, made of silicone rubber or the like, may be sandwiched between the base layer and the release layer of the fixing belt 73. According to this exemplary embodiment, the elastic layer has a thickness of 180 micrometers. The release layer constituting the outermost surface layer is a PFA tube having a thickness of 20 micrometers and coating the elastic layer.

If the fixing belt 73 does not incorporate the elastic layer, the fixing belt 73 has a decreased thermal capacity that enhances fixing property of being heated quickly to a predetermined fixing temperature at which the toner image T is fixed on the sheet P. However, the pressure roller 76 and the fixing belt 73 may not sandwich and press the unfixed toner image T on the sheet P passing through the fixing nip N evenly. Accordingly, as the sheet P is conveyed through the fixing nip N, slight surface asperities of the sheet P may be transferred onto the toner image T on the sheet P, producing an orange peel image on the sheet P. To address this circumstance, the elastic layer made of silicone rubber has a thickness not smaller than 100 micrometers. As the elastic layer deforms, the elastic layer absorbs slight surface asperities of the sheet P, preventing formation of the faulty orange peel image.

A tensional load imposed to the fixing belt 73 is in a range of from 100 N to 250 N if the sheet P is an A4 size sheet. The tensional load is imposed to the fixing belt 73 by a tension applicator, that is, a tension roller, a plate spring, or a cleaning roller, disposed opposite an axial span of the fixing belt 73.

If the tensional load imposed to the fixing belt 73 is excessively small, the fixing belt 73 may adhere to the heating roller 71 insufficiently and therefore a driving force may not be transmitted from the heating roller 71 to the fixing belt 73, causing slippage of the fixing belt 73. Conversely, if the tensional load is excessively great, a corner of the fixing pad 74 may bend the fixing belt 73, causing slippage of the fixing belt 73.

The corner of the fixing pad 74 has a curvature greater than R1 to prevent bending of the fixing belt 73. It is impossible to measure a tension imposed to the fixing belt 73 or an adhesion force adhering the fixing belt 73 to the heating roller 71 practically. Accordingly, a load imposed on the fixing belt 73 is controlled in a range of from 0.5 N/m to 10 N/m, preventing the failures described above and improving setting of the tension.

If an inner diameter of the fixing belt 73 is not greater than ϕ 25 in its natural state, for example, the fixing belt 73 incorporating the base layer made of polyimide and having a thickness of 50 micrometers may be looped into an ellipse by the strength of the fixing belt 73 achieved by the thickness thereof without application of tension to the fixing belt 73.

A description is provided of a construction of the pressure roller 76.

As shown in FIG. 2, the pressure roller 76 is a hollow or solid metal roller. The pressure roller 76 is produced by processing a solid rod or a metal pipe made of aluminum, iron, stainless steel, or the like. According to this exemplary embodiment, an iron pipe having a predetermined diameter is cut into the pressure roller 76 having a predetermined width in the axial direction thereof.

As shown in FIG. 4, a shallow groove **76*b* having a decreased depth is disposed on an outer circumferential surface of the pressure roller 76. The groove 76*b* has an increased width in the axial direction of the pressure roller 76 and spans in a circumferential direction thereof. The groove 76*b* accommodates the thermally stable elastic layer 76*a* to achieve a desired length of the fixing nip N in the sheet conveyance direction DP, desired pressure exerted at the fixing nip N, and the like. The pressure roller 76 further includes a release layer coating an outer circumferential surface of the elastic layer 76*a*. The release layer is made of resin (e.g., PFA or PTFE) to facilitate separation of the sheet P from the pressure roller 76. According to this exemplary embodiment, the elastic layer 76*a*** has a thickness of 6 mm.

For example, the elastic layer **76*a* is made of silicone rubber, solid rubber, or sponge rubber foam. The sponge rubber has an increased insulation that reduces conduction of heat from the fixing belt 73 to a cored bar including the cored bar land 76*c* of the pressure roller 76. Accordingly, the temperature of the fixing belt 73** is controlled with an improved precision.

The cored bar land **76*c* is outboard from the groove 76*b* in the axial direction of the pressure roller 76 and disposed at each lateral end of the pressure roller 76 in the axial direction thereof. The cored bar land 76*c* does not mount the elastic layer 76*a*. A diameter Da of the cored bar land 76*c* is not greater than an outer diameter Db of the elastic layer 76*a***.

As the biasing member 81 biases the fixing pad 74 to press against the pressure roller 76, the fixing pad 74 presses against and deforms the elastic layer **76*a* of the pressure roller 76 such that the fixing pad 74 caves the elastic layer 76*a*. Thus, the fixing nip N achieves a predetermined length in the sheet conveyance direction DP. For example, the length of the fixing nip N in the sheet conveyance direction DP is 5 mm. Optionally, a heater such as a halogen heater may be disposed inside the pressure roller 76. As shown in FIG. 2, according to this exemplary embodiment, the halogen heater serving as the heater 72 is disposed inside the heating roller 71 and no halogen heater is disposed inside the pressure roller 76**.

A description is provided of motion of the fixing pad 74.

As shown in FIG. 6, as the biasing member 81 biases the fixing pad 74 against the pressure roller 76, a biasing force that generates pressure used to fix the toner image T on the sheet P is exerted to the elastic layer **76*a* of the pressure roller 76. A biasing force not used to fix the toner image T on the sheet P is exerted to the cored bar land 76*c* of the pressure roller 76 that is disposed at each lateral end of the pressure roller 76 in the axial direction thereof. As shown in FIG. 4, when the fixing pad 74 is not exerted with load, the fixing belt 73 is isolated from the pressure roller 76 with an interval therebetween. The fixing belt 73 looped over the fixing pad 74 and the heating roller 71 is placed with tension constantly by the biasing member 81. The inner circumferential surface of the fixing belt 73 is adhered to the fixing pad 74 via the slide sheet 77**.

As shown in FIG. 5, when the fixing pad 74 is exerted with load, the fixing belt 73 disposed opposite the pressure roller 76 moves toward the pressure roller 76 and thereafter comes into contact with the pressure roller 76. The fixing pad 74 and the fixing belt 73 start pressing against the elastic layer 76*a* of the pressure roller 76. Thereafter, as shown in FIG. 6, as each lateral end portion 74*a* of the fixing pad 74 contacts the cored bar land 76*c* of the pressure roller 76 that is disposed at each lateral end of the pressure roller 76 in the axial direction thereof, the cored bar land 76*c* prohibits the fixing pad 74 from pressing against the elastic layer 76*a* of the pressure roller 76 further.

If the height of the cored bar land 76*c* and the height and the thickness of the elastic layer 76*a* are set to desired values, respectively, it is possible to control an amount of load imposed to the elastic layer 76*a* via the fixing belt 73, that is, an amount of load needed to fix the toner image T on the sheet P. According to this exemplary embodiment, the load imposed to the fixing pad 74 is greater than a desired value by a range of from about 10 N to about 20 N.

Accordingly, even if the height of the cored bar land 76*c* and the height and the thickness of the elastic layer 76*a* vary, it is possible to impose a target load to the elastic layer 76*a* via the fixing belt 73. A desired value of the target load is a value of the load to be imposed to the elastic layer 76*a* to fix the toner image T on the sheet P while the elastic layer 76*a* thermally expands after the heater 72 heats the fixing belt 73.

The elastic layer 76*a* is in contact with and contiguous to the cored bar land 76*c* disposed at each lateral end of the pressure roller 76 in the axial direction thereof with no interval therebetween. FIGS. 4 to 6 intentionally illustrate a slight interval between the elastic layer 76*a* and the cored bar land 76*c* at each lateral edge of the elastic layer 76*a* in the axial direction of the pressure roller 76 to show a boundary of the elastic layer 76*a*. However, the slight interval is not provided practically. If the interval is provided between each lateral edge of the elastic layer 76*a* and an edge of the groove 76*b* in the axial direction of the pressure roller 76, as the fixing pad 74 presses against the elastic layer 76*a*, the elastic layer 76*a* is deformed and elongated outward in the axial direction of the pressure roller 76 to eliminate the interval. Accordingly, the deformed elastic layer 76*a* decreases pressure exerted at each lateral end of the fixing nip N in the axial direction of the pressure roller 76. Consequently, desired pressure to fix the toner image T on the sheet P is not achieved at each lateral end of the fixing nip N in the axial direction of the pressure roller 76, degrading fixing performance.

As the elastic layer 76*a* is deformed and elongated outward in the axial direction of the pressure roller 76, the deformed elastic layer 76*a* may decrease the length of the fixing nip N in the sheet conveyance direction DP, creasing the sheet P conveyed through the fixing nip N. To address this circumstance, the width of the elastic layer 76*a* in the axial direction of the pressure roller 76 is set to prevent production of the interval between each lateral edge of the elastic layer 76*a* and the cored bar land 76*c* in the axial direction of the pressure roller 76.

An amount of radial thermal expansion of the elastic layer 76*a*, varying depending on the temperature and the property of rubber of the elastic layer 76*a*, is about 10 percent of the thickness of the elastic layer 76*a* at temperatures in a range of from 150 degrees centigrade to 200 degrees centigrade. According to this exemplary embodiment, since the elastic layer 76*a* has a thickness of 6 mm, the elastic layer 76*a* thermally expands radially toward the fixing pad 74 by about 0.6 mm. Accordingly, the fixing pad 74 presses against the pressure roller 76 with a pressing amount decreased by an amount slightly smaller than 0.6 mm.

As shown in FIG. 2, the fixing belt 73 is looped over the fixing pad 74 and the heating roller 71 with a desired tension. Accordingly, although varying depending on the property of rubber of the fixing belt 73 and the load imposed to the fixing belt 73, if the pressure roller 73 presses back against the fixing pad 74 merely by about 0.4 mm, the plate spring serving as a tension applicator may increase an actuation span, decreasing tension placed on the fixing belt 73. Accordingly, an interval between a skew restraint brim disposed opposite a lateral edge of the fixing pad 74 and the lateral edge of the fixing belt 73 in the axial direction thereof decreases. Consequently, as the fixing belt 73 skews in the axial direction thereof and strikes the skew restraint brim, the lateral end of the fixing belt 73 in the axial direction thereof is susceptible to breakage. According to this exemplary embodiment, the skew restraint face 6213 of the lateral end support plate 621 shown in FIG. 3 serves as the skew restraint brim.

Although the plate spring offsets decrease in tension of the fixing belt 73 caused by thermal expansion of the pressure roller 76 to some extent, the plate spring does not achieve stable rotation of the fixing belt 73 precisely. An experiment was performed to examine whether or not the lateral end of the fixing belt 73 in the axial direction thereof suffers from breakage as thermal expansion of the pressure roller 76 changes. The experiment showed that even if the thermally expanded pressure roller 76 pressed back the fixing pad 74 by 0.3 mm, the lateral end of the fixing belt 73 in the axial direction thereof was not broken and the fixing belt 73 attained stable conveyance of the sheet P.

Conversely, if the thermally expanded pressure roller 76 pressed back the fixing pad 74 by 0.4 mm, after the fixing belt 73 conveyed 1,500 sheets for about an hour with an interval provided whenever the fixing belt 73 conveyed 3 sheets at a velocity of 180 mm/s, the lateral end of the fixing belt 73 in the axial direction thereof was broken. To address this circumstance, the fixing pad 74 is allowed to be pressed back by a retraction length determined by considering a margin to breakage of the lateral end of the fixing belt 73 in the axial direction thereof. For example, the retraction length of the fixing pad 74 is not greater than 0.2 mm.

As the sheet P is conveyed through the fixing nip N, the fixing pad 74 is retracted from the pressure roller 76 by the thickness of the sheet P. Since the thickness of the sheet P is in a range of from about 0.05 mm to about 0.1 mm, the allowable retraction length of the fixing pad 74 is about 0.1 mm in view of the above described retraction length of the fixing pad 74 that is not greater than 0.2 mm. Hence, practically, the fixing pad 74 is not allowed to be pressed back by thermal expansion of the elastic layer 76*a* of the pressure roller 76.

As shown in FIG. 6, as the fixing pad 74 contacts the cored bar land 76*c* that is disposed at each lateral end of the pressure roller 76 and is outboard from the elastic layer 76*a* in the axial direction of the pressure roller 76, the cored bar land 76*c* prohibits the fixing pad 74 from pressing against the pressure roller 76 further. Accordingly, the fixing pad 74 stops at an identical stop position every time. The cored bar land 76*c* defines the pressing amount of the fixing pad 74 pressing against the pressure roller 76. The interval between the skew restraint face 6213 serving as the skew restraint brim that restricts skew of the fixing belt 73 and the lateral edge of the fixing belt 73 in the axial direction thereof is increased most at the stop position defined by the cored bar land 76*c*, thus preventing breakage of the lateral end of the fixing belt 73 in the axial direction thereof and stabilizing rotation of the fixing belt 73 for an extended period of time.

As described above, in order to even the length of the fixing nip N in the sheet conveyance direction DP throughout the entire span in the axial direction of the fixing belt 73, the shaft 76*d* of the pressure roller 76 is fixedly positioned and the biasing member 81 presses the fixing pad 74 against the cored bar land 76*c* that is disposed at each lateral end of the pressure roller 76 and is outboard from the elastic layer 76*a* in the axial direction of the pressure roller 76. The fixing pad 74 is retracted from the fixing nip N by the sheet P conveyed through the fixing nip N and is not retracted from the fixing nip N due to the temperature of the fixing belt 73, thus stabilizing rotation of the fixing belt 73. The width of the fixing belt 73 is smaller than a width of the elastic layer 76*a* in the axial direction of the pressure roller 76, preventing the lateral edge of the fixing belt 73 in the axial direction thereof from being sandwiched between the fixing pad 74 and a lateral edge of the pressure roller 76 in the axial direction thereof.

After deformation, the thickness of the elastic layer 76*a* is not smaller than 80 percent thereof before deformation. That is, a deformation rate is smaller than 20 percent. If the elastic layer 76*a* is under pressure continuously for an increased period of time with a percentage smaller than 80 percent of the thickness thereof before deformation at a deformation rate not smaller than 20 percent, the elastic layer 76*a* loses elasticity to some extent under permanent strain. Accordingly, predetermined adhesion pressure is not secured between the fixing pad 74 and the pressure roller 76. If the predetermined adhesion pressure is not secured, the length of the fixing nip N in the sheet conveyance direction DP is uneven in the axial direction of the fixing belt 73. Accordingly, the fixing belt 73 may skew in the axial direction thereof. Consequently, the lateral end of the fixing belt 73 in the axial direction thereof may be damaged and the sheet P may be jammed between the fixing belt 73 and the pressure roller 76.

A description is provided of a configuration of a fixing device 7S as a variation of the fixing device 7 described above.

The present disclosure is not limited to the details of the exemplary embodiments described above and various modifications and improvements are possible.

In the fixing device 7 shown in FIG. 6, as each lateral end portion 74*a* of the fixing pad 74 in the longitudinal direction thereof contacts the cored bar land 76*c* disposed at each lateral end of the pressure roller 76 in the axial direction thereof, the cored bar land 76*c* prohibits the fixing pad 74 from pressing against the pressure roller 76 further, thus serving as a stopper that stops the fixing pad 74. However, the stopper may be modified.

Figure 8:
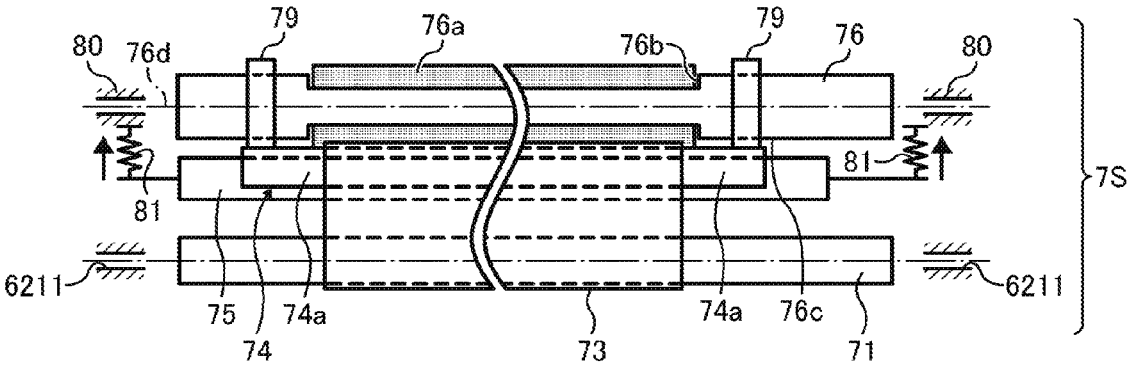
FIG. 8 is a plan view of a fixing device as a variation of the fixing device shown in FIG. 6.

FIG. 8 is a plan view of the fixing device 7S. As shown in FIG. 8, the fixing device 7S includes a bearing 79 disposed outboard from the elastic layer 76*a* in the axial direction of the pressure roller 76 to rotatably support the pressure roller 76. As each lateral end portion 74*a* of the fixing pad 74 in the longitudinal direction thereof contacts the bearing 79 or a periphery of the bearing 79, the bearing 79 prohibits the fixing pad 74 from pressing against the pressure roller 76 further, thus serving as a stopper that stops the fixing pad 74. Since the pressure roller 76 rotates in the rotation direction D76 as shown in FIG. 2, as the fixing pad 74 contacts the pressure roller 76, the fixing pad 74 and the pressure roller 76 may be susceptible to abrasion and frictional heat. Advantageously, since the bearing 79 and the periphery of the bearing 79 do not rotate, the fixing pad 74 and the pressure roller 76 are immune from abrasion and frictional heat.

Alternatively, as each lateral end of the stay 75 in the longitudinal direction thereof contacts the cored bar land 76*c* disposed at each lateral end of the pressure roller 76 and outboard from the elastic layer 76*a* in the axial direction of the pressure roller 76, the cored bar land 76*c* may prohibit the fixing pad 74 mounted on the stay 75 from pressing against the pressure roller 76 further, thus serving as a stopper that stops the fixing pad 74. Yet alternatively, as each lateral end of the stay 75 in the longitudinal direction thereof contacts the bearing 79 or the periphery of the bearing 79 disposed at each lateral end of the pressure roller 76 and outboard from the elastic layer 76*a* in the axial direction of the pressure roller 76 to rotatably support the pressure roller 76, the bearing 79 or the periphery of the bearing 79 may prohibit the fixing pad 74 from pressing against the pressure roller 76 further, thus serving as a stopper that stops the fixing pad 74.

Yet alternatively, as each lateral end of the stay 75 in the longitudinal direction thereof shown in FIG. 3 contacts an edge, that is, an interior wall, of the rectangular stay supporting through-hole 6212 of the lateral end support plate 621, the rectangular stay supporting through-hole 6212 may prohibit the fixing pad 74 from pressing against the pressure roller 76 further. Thus, the lateral end support plate 621 including the rectangular stay supporting through-hole 6212 serves as a stopper that stops the fixing pad 74. Thus, the stopper may be modified into variations thereof without being limited to the configurations according to the exemplary embodiments described above.

The fixing device 7S depicted in FIG. 8 does not use the cored bar land 76*c* as the stopper. Hence, the groove 76*b* of the pressure roller 76 may be eliminated. If the groove 76*b* is omitted, the pressure roller 76 is processed at reduced manufacturing costs. FIG. 8 illustrates the bearing 79 conceptually. Hence, the shape and the position of the bearing 79 are not limited to those shown in FIG. 8. For example, the lateral end support plate 621 shown in FIG. 3 may be used as the bearing 79.

A description is provided of advantages of the fixing devices 7 and 7S.

As shown in FIGS. 2, 3, 6, and 8, the fixing devices 7 and 7S include the pressure roller 76 driven and rotated by the driver 90 in a state in which the shaft 76*d* of the pressure roller 76 is fixedly secured to a support (e.g., the bearing 80). The pressure roller 76 includes the elastic layer 76*a* coating the outer circumferential surface of the pressure roller 76. The fixing belt 73 is disposed opposite the pressure roller 76 and formed into a loop rotatable in the rotation direction D73. The fixing pad 74 is disposed inside the loop formed by the fixing belt 73 and separably pressed against the pressure roller 76. The biasing member 81 biases the fixing pad 74 against the pressure roller 76 via the fixing belt 73. A stopper (e.g., the cored bar land 76*c*, the bearing 79, and the rectangular stay supporting through-hole 6212) restricts motion of the fixing pad 74 biased by the biasing member 81 to move to a closest position where the fixing pad 74 is closest to or in contact with the pressure roller 76. While the stopper contacts the fixing pad 74 to retain the fixing pad 74 at the closest position, a sheet P serving as a recording medium bearing a toner image T is conveyed through the fixing nip N formed between the elastic layer 76*a* of the pressure roller 76 and the fixing belt 73 pressed against the pressure roller 76 by the fixing pad 74 so as to fix the toner image T on the sheet P.

Accordingly, the stopper maintains the constant pressing amount of the fixing pad 74 pressing against the elastic layer 76*a* of the pressure roller 76 regardless of thermal expansion of the elastic layer 76*a*. The stopper attains the constant length of the fixing nip N in the sheet conveyance direction DP and the constant tension of the fixing belt 73 throughout the entire width of the pressure roller 76 in the axial direction thereof. Thus, the stopper restricts motion or skew of the fixing belt 73 in the axial direction thereof and therefore prevents breakage of the lateral end of the fixing belt 73 in the axial direction thereof. Additionally, the stopper prevents change in the conveyance path of the sheet P, that is, the sheet conveyance direction DP, and therefore prevents the sheet P from being jammed between the fixing belt 73 and the pressure roller 76.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing belt formed into a loop rotatable in a predetermined direction of rotation;

a pressure roller disposed opposite the fixing belt, the pressure roller including:

a shaft fixedly positioned; and a deformable elastic layer;

a fixing pad disposed inside the loop formed by the fixing belt and separably pressed against the pressure roller via the fixing belt to form a fixing nip between the fixing belt and the pressure roller, through which a recording medium bearing a toner image is conveyed;

a biasing member to bias the fixing pad and the fixing belt against the pressure roller; and a stopper to restrict motion of the fixing pad biased by the biasing member, the stopper to contact the fixing pad while the recording medium bearing the toner image is conveyed through the fixing nip, wherein a width of the fixing pad is greater than a width of the elastic layer in an axial direction of the pressure roller, wherein the fixing pad includes a lateral end portion disposed outboard from the fixing belt in an axial direction thereof, the lateral end portion to come into contact with the stopper, wherein the stopper includes a cored bar disposed outboard from the elastic layer and disposed at each lateral end of the pressure roller in the axial direction thereof, and a distance between the fixing pad and the elastic layer of the pressure roller is smaller than a distance between the fixing pad and the stopper when the fixing pad is not pressed against the pressure roller via the fixing belt.

2. The fixing device according to claim 1, wherein the elastic layer contacts the cored bar with no interval therebetween in the axial direction of the pressure roller.

3. The fixing device according to claim 1, wherein a diameter of the cored bar is not greater than an outer diameter of the elastic layer.

4. An image forming apparatus comprising the fixing device of claim 1.

5. The fixing device according to claim 1, wherein:

the stopper contacts the fixing pad in a longitudinal direction of the fixing pad.

6. The fixing device according to claim 1, wherein:

the stopper is not disposed opposite a lateral end face of the fixing pad in the axial direction of the fixing belt.

7. A fixing device comprising:

a fixing belt formed into a loop rotatable in a predetermined direction of rotation;

a pressure roller disposed opposite the fixing belt, the pressure roller including:

a shaft fixedly positioned; and a deformable elastic layer;

a fixing pad disposed inside the loop formed by the fixing belt and separably pressed against the pressure roller via the fixing belt to form a fixing nip between the fixing belt and the pressure roller, through which a recording medium bearing a toner image is conveyed;

a biasing member to bias the fixing pad and the fixing belt against the pressure roller; and a stopper to restrict motion of the fixing pad biased by the biasing member, the stopper to contact the fixing pad while the recording medium bearing the toner image is conveyed through the fixing nip, wherein the stopper includes a cored bar disposed outboard from the elastic layer and disposed at each lateral end of the pressure roller in the axial direction thereof, and wherein a distance between the fixing pad and the elastic layer of the pressure roller is smaller than a distance between the fixing pad and the stopper when the fixing pad is not pressed against the pressure roller via the fixing belt.

8. The fixing device according to claim 7, wherein a width of the fixing pad is greater than a width of the elastic layer in an axial direction of the pressure roller.

9. The fixing device according to claim 7, wherein the elastic layer contacts the cored bar with no interval therebetween in the axial direction of the pressure roller.

10. The fixing device according to claim 7, wherein a diameter of the cored bar is not greater than an outer diameter of the elastic layer.

11. An image forming apparatus comprising the fixing device of claim 7.

12. The fixing device according to claim 7, wherein:

the stopper contacts the fixing pad in a longitudinal direction of the fixing pad.

13. The fixing device according to claim 7, wherein:

the stopper is not disposed opposite a lateral end face of the fixing pad in the axial direction of the fixing belt.

* * * * *